US012150580B2

(12) United States Patent
Cheng

(10) Patent No.: US 12,150,580 B2
(45) Date of Patent: Nov. 26, 2024

(54) COOLING PILLOW

(71) Applicant: Matthew Cheng, Los Alamitios, CA (US)

(72) Inventor: Matthew Cheng, Los Alamitios, CA (US)

( * ) Notice: Subject to any disclaimer, the term of this patent is extended or adjusted under 35 U.S.C. 154(b) by 309 days.

(21) Appl. No.: 17/891,855

(22) Filed: Aug. 19, 2022

(65) Prior Publication Data

US 2024/0057796 A1 Feb. 22, 2024

(51) Int. Cl.

*A47G 9/10* (2006.01)
*A47C 21/04* (2006.01)
*A47G 9/02* (2006.01)

(52) U.S. Cl.

CPC ..... *A47G 9/1036* (2013.01); *A47C 21/042* (2013.01); *A47C 21/044* (2013.01); *A47C 21/046* (2013.01); *A47G 9/0215* (2013.01); *A47G 2009/1018* (2013.01)

(58) Field of Classification Search

CPC ..... A47G 9/1036; A47G 9/0215; A47G 2009/1018; A47G 2200/16

See application file for complete search history.

(56) References Cited

U.S. PATENT DOCUMENTS 2,938,356 A * 5/1960 McMahon ..... A61F 7/007 297/180.12
3,080,723 A * 3/1963 Price ..... H05B 3/342 62/3.5
3,099,137 A * 7/1963 Jamison ..... H10N 10/17 62/3.5
3,132,688 A * 5/1964 Nowak ..... A47C 21/048 602/14
3,136,577 A * 6/1964 Richard ..... B60N 2/5692 219/217
3,648,469 A * 3/1972 Chapman ..... H10N 10/00 5/636
4,859,250 A * 8/1989 Buist ..... H10N 10/817 5/636
4,969,684 A * 11/1990 Zarotti ..... A47C 27/082 297/284.3
5,416,935 A * 5/1995 Nieh ..... A47C 21/044 297/180.13
5,448,788 A * 9/1995 Wu ..... A47C 21/048 5/421
6,073,998 A * 6/2000 Siarkowski ..... A47C 7/748 297/219.11
6,557,353 B1 * 5/2003 Fusco ..... F25B 21/02 62/3.5
8,316,649 B2 * 11/2012 Wolske ..... A61F 7/08 62/3.5

(Continued)

*Primary Examiner* — Justin C Mikowski
*Assistant Examiner* — Morgan J McClure
(74) *Attorney, Agent, or Firm* — Clement Cheng

(57) ABSTRACT

A cooling pillow has a cooler module, a heatsink module. The heatsink module is formed in the cooler module. The peltier cooler has a bottom side and a top side. The peltier cooler transfers heat from the bottom side of the peltier cooler to the heatsink module. The water tube absorbs heat from the heatsink module. The fiberglass bottom stabilizes the heatsink module. The fiberglass bottom also insulates the heat within the cooler module. The pressure sensor is formed in the cooler module. The pressure sensor measures pressure from the user. The pillow antenna is formed within the cooler module.

10 Claims, 4 Drawing Sheets

(56) References Cited

U.S. PATENT DOCUMENTS 9,105,808 B2 * 8/2015 Petrovski ..... H10N 10/17
9,335,073 B2 * 5/2016 Lofy ..... B60N 2/5692
9,380,895 B2 * 7/2016 Dungan ..... A47G 9/1036
9,622,588 B2 * 4/2017 Brykalski ..... A47C 21/04
9,857,107 B2 * 1/2018 Inaba ..... H10N 10/17
9,913,546 B2 * 3/2018 Chandler ..... A47C 21/048
10,005,337 B2 * 6/2018 Petrovski ..... B60N 2/5635
10,247,452 B2 * 4/2019 Tseng ..... A47C 7/72
10,363,845 B2 * 7/2019 Dry ..... G05D 23/1931
10,405,667 B2 * 9/2019 Marquette ..... F24H 3/0429
10,737,597 B2 * 8/2020 Dry ..... G05D 23/1931
10,820,729 B2 * 11/2020 Huang ..... A47G 9/109
10,991,869 B2 * 4/2021 Jovovic ..... H10N 10/81
11,639,816 B2 * 5/2023 Cauchy ..... H10N 10/17
62/3.7
2004/0098804 A1 * 5/2004 Varadharajulu ..... A61B 6/0487
5/607
2005/0278856 A1 * 12/2005 Welch ..... A47D 5/006
5/655
2008/0052837 A1 * 3/2008 Blumberg ..... A47C 27/10
600/300
2012/0110734 A1 * 5/2012 An ..... A47C 21/048
5/423
2012/0198616 A1 * 8/2012 Makansi ..... H01C 13/02
136/200
2013/0111668 A1 * 5/2013 Wiggers ..... A61N 5/1049
5/608
2015/0033474 A1 * 2/2015 Mikkelsen ..... A47C 21/044
5/421
2016/0145996 A1 * 5/2016 Goodman ..... E21B 43/1185
166/243
2016/0254209 A1 * 9/2016 Oohiraki ..... H01L 23/3675
257/707
2017/0160007 A1 * 6/2017 Liptak ..... F25D 31/007
2017/0354190 A1 * 12/2017 Cauchy ..... B60N 2/5635
2018/0020841 A1 * 1/2018 Mitsuzuka ..... G01L 1/24
5/737
2019/0307270 A1 * 10/2019 Blum ..... A47G 9/1036
2021/0039326 A1 * 2/2021 DiChiara ..... B29C 66/91655
2022/0000191 A1 * 1/2022 Cauchy ..... B60N 2/5635
2023/0092084 A1 * 3/2023 Qiu ..... A47C 7/742
297/217.3
2023/0143759 A1 * 5/2023 Tsern ..... A47C 31/123
5/423
2023/0221083 A1 * 7/2023 Balma ..... F28F 3/02
165/185
2023/0384222 A1 * 11/2023 Nick ..... G01N 21/6458
2023/0390154 A1 * 12/2023 Taylor ..... A61H 33/0087

* cited by examiner

COOLING PILLOW

FIELD OF THE INVENTION

The present invention is in the field of cooling pillows.

REFERENCE TO RELATED ART

A variety of different cooling pillows have been described in patent publications. For example, an invention that involves the use of a pillow to cool a user's head is CN Pat. No. 205030925 to Xihua University, entitled Built-In Semiconductor Refrigeration Piece Water-Cooling Pillow, having an issue date of Feb. 17, 2016, the disclosure of which is incorporated herein by reference. It is a cooling pillow made in China that has a fan that cools aquogel which cools itself through the radiator on the bottom. It also has two fans on the back side that cool the radiator. It could be loud and aquogel is difficult to find.

A water cooled pillow is described TW patent No. 201225890 to Fu-Jing Cheng, entitled Water-Cooled Pillow Structure, having an issue date of Jul. 1, 2012, the disclosure of which is incorporated herein by reference. The pillow is made of a hard material that dissipates heat. It is made in Taiwan and has a water bag inside that is curved in a wavy shape to provide comfort.

An invention that involves the use of Peltier cooling modules to cool a pillow is US patent No. 20190307270 to Ronald D. Blum and Amitava Gupta, entitled Cooling Pillow, having an issue date of Oct. 10, 2019, the disclosure of which is incorporated herein by reference. With an abandoned patent, this cooling pillow has cubic modules of phase change material close to the surface where the head is placed and uses a Peltier module to cool the strips of phase change material. This looks very uncomfortable and has many figures with cooling strips placed in different areas.

An invention that involves the use of compressed air to cool a pillow is US patent No. 2018014011 to Marc L. Werner, entitled Cooling Pillow, having a publication date of May 24, 2018, the disclosure of which is incorporated herein by reference. This pillow has phase change material and has many holes around the foam that takes in air like a sponge. When compressed, the air inside the pillow cools down the phase change material within the pillow which cools the pillow. This seems impractical as once the pillow loses all of its air, one would have to let it re-inflate itself.

An invention that involves the use of thermoelectric cooling to cool a pillow is U.S. Pat. No. 3,648,469 to James E Chapman, entitled Cooling Pillow, having a publication date of Mar. 14, 1972, the disclosure of which is incorporated herein by reference. This pillow has a radiator in the middle that picks up heat from one side of the pillow and transfers it to the other side. It uses electric current with the Peltier effect in order to transfer the heat. This type of cooling would be quite situational as people who sleep with their arm(s) under their pillow would have warm arms.

SUMMARY OF THE INVENTION

A cooling pillow has a cooler module, a heatsink module. The heatsink module is formed in the cooler module. The peltier cooler has a bottom side and a top side. The peltier cooler transfers heat from the bottom side of the peltier cooler to the heatsink module. The water tube absorbs heat from the heatsink module. The fiberglass bottom stabilizes the heatsink module. The fiberglass bottom also insulates the heat within the cooler module. The pressure sensor is formed in the cooler module. The pressure sensor measures pressure from the user. The pillow antenna is formed within the cooler module.

The connected device is connected to the pillow antenna. The light strip is connected to the pressure sensor. The light strip lights up according to the connected device. The fan is formed in the cooler module The fan blows air onto the heatsink module. The pillow case is situated around the pillow. The pillow cover is situated around the pillow case. The pillow cover passively cools the user. The air conduit releases air from the fan. The fan transfers heat from the heatsink out of the air conduit. The foam body surrounds the cooler module columns. The foam body is infused with phase change material gel. The electrical plug powers the cooler module columns. The cooler module column comprises of 10 cooler modules, all parallel to one another. The cooler module column is powered by the electrical plug. The cooler module cools the phase change material pack. The phase change material pack casing encloses the phase change material pack. The wireless connector includes a connection to the connected device. The wireless connector is configured to receive control signals from the connected device. The radiator is a passive cooling radiator. The water tube transfers heat.

Figure 1:
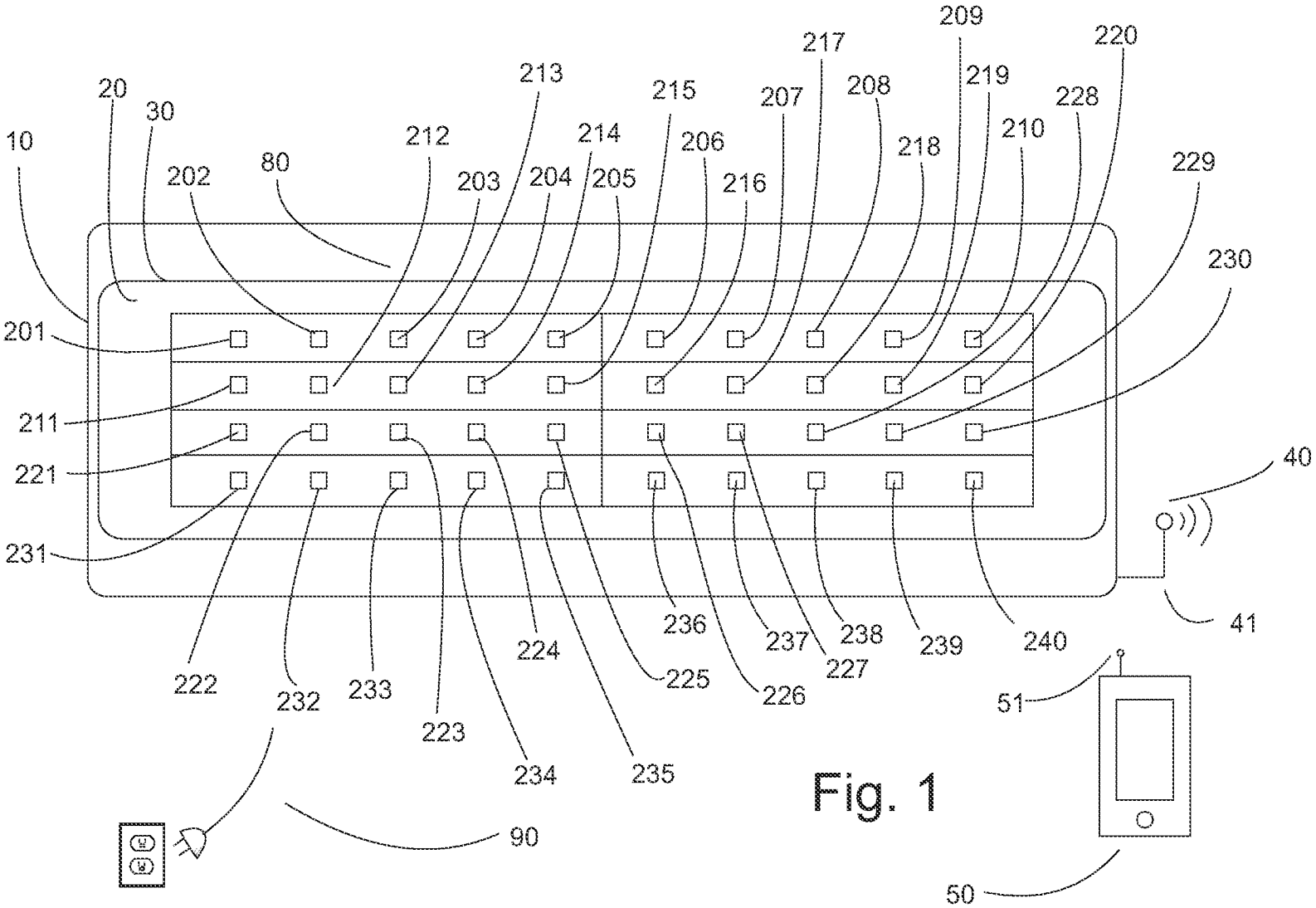
FIG. 1 is a top cross section view of the present invention.

The following callout list of elements can be a useful guide in referencing the element numbers of the drawings.

10 Pillowcase
20 Optional Phase Change Material Pack
30 Optional Phase Change Material Pack Casing
40 Bluetooth connector
41 Pillow Antenna
50 Connected device
51 Mobile Device Antenna
80 Foam Body
90 Electrical plug
201 1st Cooler Module
202 2nd Cooler Module
203 3rd Cooler Module
204 4th Cooler Module
205 5th Cooler Module
206 6th Cooler Module
207 7th Cooler Module
208 8th Cooler Module
209 9th Cooler Module
210 10th Cooler Module
211 11st Cooler Module
212 12nd Cooler Module
213 13rd Cooler Module
214 14th Cooler Module
215 15th Cooler Module
216 16th Cooler Module
217 17th Cooler Module
218 18th Cooler Module
219 19th Cooler Module
220 20th Cooler Module
221 21st Cooler Module
222 22nd Cooler Module
223 23rd Cooler Module
224 24th Cooler Module

225 25th Cooler Module
226 26th Cooler Module
227 27th Cooler Module
228 28th Cooler Module
229 29th Cooler Module
230 30th Cooler Module
231 31st Cooler Module
232 32nd Cooler Module
233 33rd Cooler Module
234 34th Cooler Module
235 35th Cooler Module
236 36th Cooler Module
237 37th Cooler Module
238 38th Cooler Module
239 39th Cooler Module
240 40th Cooler Module
110 1st Cooler Module Column
120 2nd Cooler Module Column
130 3rd Cooler Module Column
140 4th Cooler Module Column
150 5th Cooler Module Column
160 6th Cooler Module Column
170 7th Cooler Module Column
180 8th Cooler Module Column
190 9th Cooler Module Column
200 10th Cooler Module Column
300 Pillow Top Front Side
301 Pillow Left Front Edge
302 Pillow Front Right Edge
303 Pillow Top Right Edge
304 Pillow Right Rear Edge
305 Pillow Bottom Right Edge
306 Pillow Bottom Opening
307 Pillow Bottom Rear Edge
308 Pillow Bottom Left Edge
309 Pillow Front Bottom Edge
310 Peltier cooler board
321 1st Peltier Cooler
322 2nd Peltier Cooler
323 3rd Peltier Cooler
324 4th Peltier Cooler
325 5th Peltier Cooler
326 1st Fiberglass Bottom
327 2nd Fiberglass Bottom
328 3rd Fiberglass Bottom
329 4th Fiberglass Bottom
330 5th Fiberglass Bottom
331 1st Heatsink Grouping
332 2nd Heatsink Grouping
333 3rd Heatsink Grouping
334 4th Heatsink Grouping
335 5th Heatsink Grouping
336 1st Fan
337 2nd Fan
338 3rd Fan
339 4th Fan
340 5th Fan
341 6th Fan
342 7th Fan
343 8th Fan
344 Liquid Tubing
345 air conduit
410 1st LED Light Strip
420 2nd LED light Strip
430 Upper ceramic substrate
440 Lower ceramic substrate
450 Pressure sensor
460 Pressure sensor backing
470 Thermoelectric Legs

DETAILED DESCRIPTION OF THE PREFERRED EMBODIMENT

As seen in FIG. 1, the present invention includes a pillowcase 10 that wraps around the foam body 80. The foam body 80 is a viscoelastic polyurethane foam infused with a phase change material gel. The invention comes with an optional phase change material pack 20. The phase change material pack 20 also comes with an optional phase change material pack casing 30. The present invention includes an electrical plug 90 that can be used to charge the pillow's Cooler Modules. The Cooler Modules include a 1st Cooler Module 201, 2nd Cooler Module 202, 3rd Cooler Module 203, 4th Cooler Module 204, 5th Cooler Module 205, 6th Cooler Module 206, 7th Cooler Module 207, 8th Cooler Module 208, 9th Cooler Module 209, 10th Cooler Module 210, 11st Cooler Module 211, 12nd Cooler Module 212, 13rd Cooler Module 213, 14th Cooler Module 214, 15th Cooler Module 215, 16th Cooler Module 216, 17th Cooler Module 217, 18th Cooler Module 218, 19th Cooler Module 219, 20th Cooler Module 220, 21st Cooler Module 221, 22nd Cooler Module 222, 23rd Cooler Module 223, 24th Cooler Module 224, 25th Cooler Module 225, 26th Cooler Module 226, 27th Cooler Module 227, 28th Cooler Module 228, 29th Cooler Module 229, 30th Cooler Module 230, 31st Cooler Module 231, 32nd Cooler Module 232, 33rd Cooler Module 233, 34th Cooler Module 234, 35th Cooler Module 235, 36th Cooler Module 236, 37th Cooler Module 237, 38th Cooler Module 238, 39th Cooler Module 239, and a 40th Cooler Module 240. Having forty Cooler Modules allows selective cooling upon the pillow's active surface. The pillow's active surface is the surface in which certain Cooler Modules are active, corresponding to area that has pressure from supporting a user. The present invention includes a pillow antenna 41 with a wireless Bluetooth connector 40 that connects to any connected device 50 and its connected device antenna 51. A user could monitor his sleep with his connected device 50.

Figure 2:
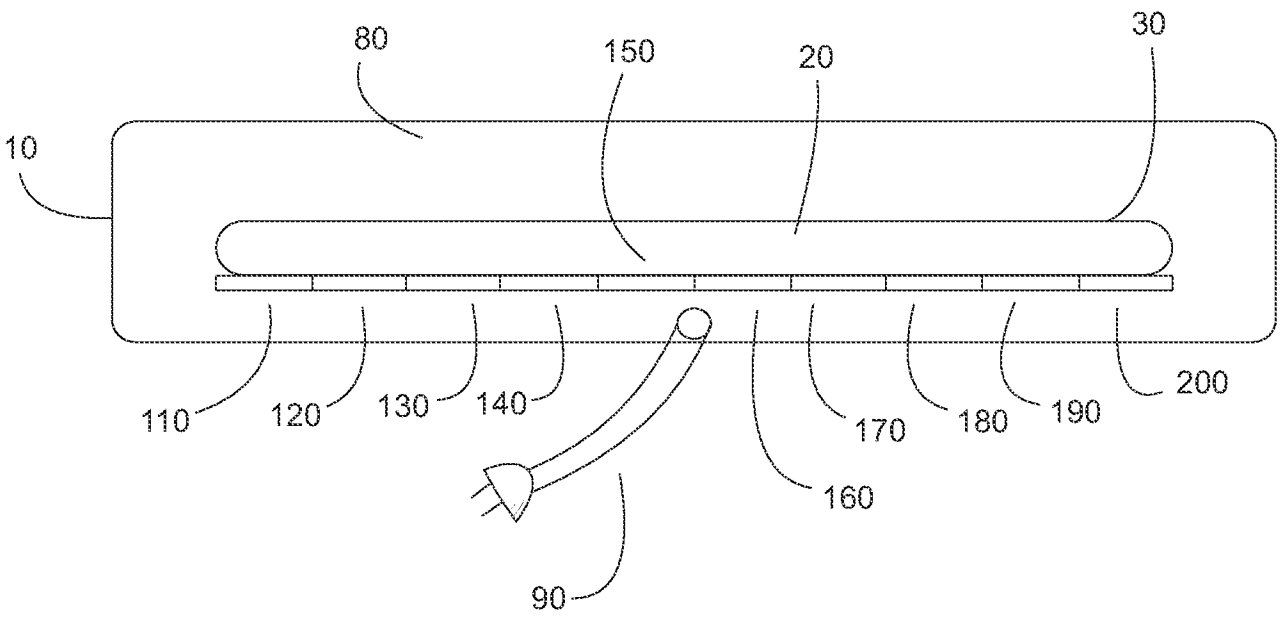
FIG. 2 is a side cross section view of the present invention.

As seen in FIG. 2, the present invention includes a pillowcase 10 that wraps around the foam body 80, which houses the Cooler Module columns. The Cooler Module columns have and optional phase change material pack 20 within an optional phase change material pack casing 30. The Cooler Module columns include a 1st Cooler Module column 110, 2nd Cooler Module column 120, 3rd Cooler Module column 130, 4th Cooler Module column 140, 5th Cooler Module column 150, 6th Cooler Module column 160, 7th Cooler Module column 170, 8th Cooler Module column 180, 9th Cooler Module column 190, and a 10th Cooler Module column 200. Each Cooler Module column contains 5 Cooler Modules. The Cooler Module columns allow The Cooler Modules too be monitored and installed more efficiently. Be face change material pack 20 is installed directly above the Cooler Module columns to absorb the heat of the user over a higher surface area. The phase change material pack casing 30 allows for even distribution of phase change material within the phase change material pack 20.

Figure 3:
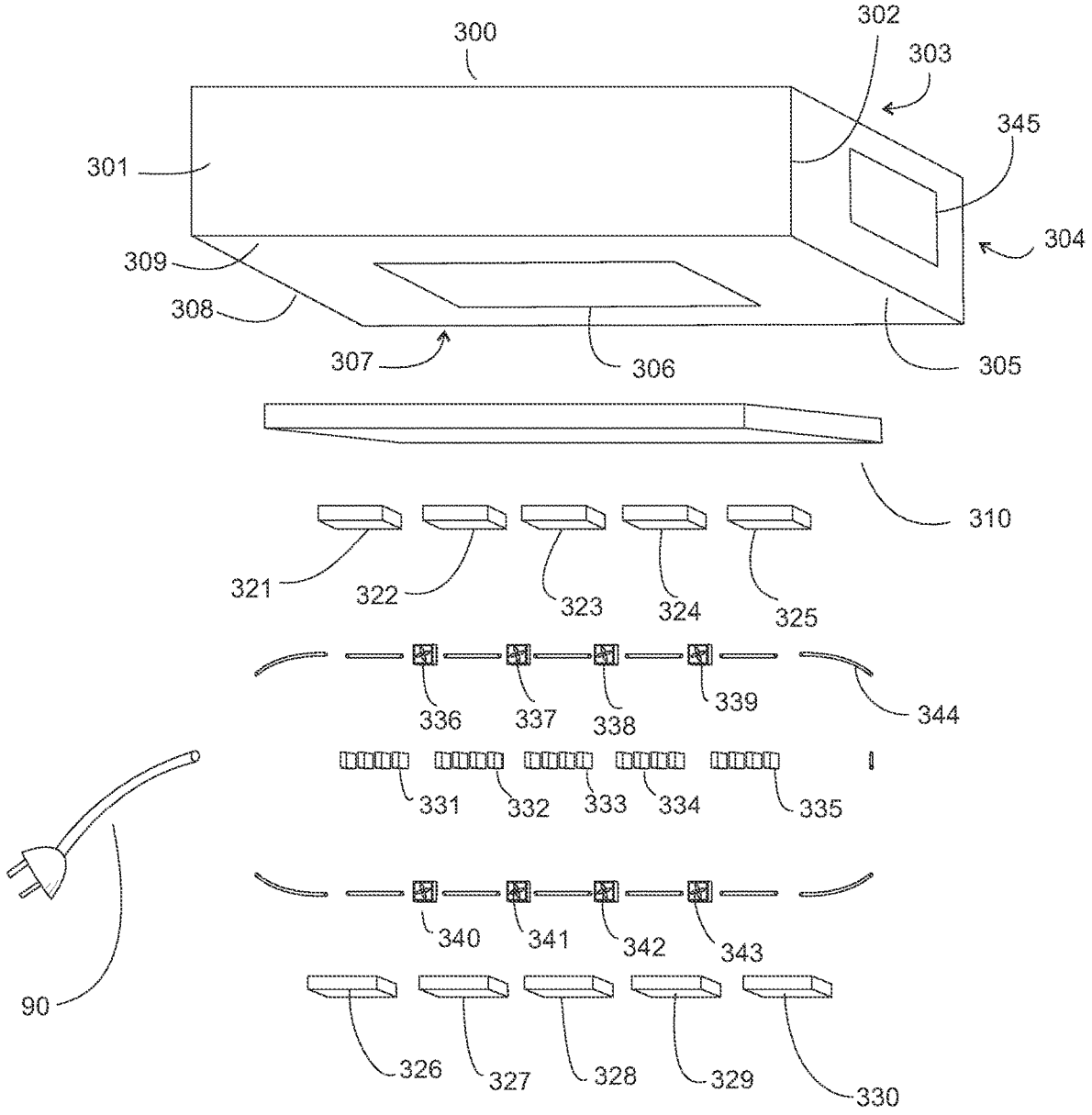
FIG. 3 is an exploded view.

As seen in FIG. 3, the present invention has a top front side 300, left front edge 301, front right edge 302, top right edge 303, right rear edge 304, bottom right edge 305, bottom opening 306, bottom rear edge 307, bottom left edge 308, front bottom edge 309. The present invention's top front side 300 is directly above the present invention's front bottom edge 309. The invention's left front edge 301 is directly across from the inventions front right edge 302. The bottom opening 306 visually depicts where the Cooler Modules will be installed. The left front edge 301, front right edge 302, and right rear edge 304 are all the same height In order to create an evenly sized pillow for the user. The Peltier cooler board 310 allows the Cooler Modules installed onto it to be stable, therefore optimizing cooling. The present invention's Cooler Modules have a 1st Peltier Cooler 321, 2nd Peltier Cooler 322, 3rd Peltier Cooler 323, 4th Peltier Cooler 324, and a 5th Peltier Cooler 325. The Peltier Coolers use electric current to move heat from the pillow to the bottom side of the Peltier Cooler. The heat from the bottom of the Peltier Coolers is then transferred to the heatsinks groupings. The present invention has a 1st Heatsink Grouping 331, 2nd Heatsink Grouping 332, 3rd Heatsink Grouping 333, 4th Heatsink Grouping 334, and a 5th Heatsink Grouping 335. The heat sink groupings are fitted with liquid tubes 344 that absorb the heat from the heat sink groupings. The liquid tubes carry the heat from the heat sink to an outside radiator that is not shown. This radiator naturally releases heat from itself. The liquid moves throughout the liquid tubes 344 through a liquid pump that is not shown. The liquid cooling provides a quieter way do displace heat from the pillow. The pillow also has an air-cooling option that is faster, but louder than the liquid cooling option. The Cooler Modules use fans placed evenly throughout the Cooler Modules in order to evenly remove heat from the pillow. The hot air is moved out of the pillow through the air conduit 345. The present invention has a 1st fan 336, 2nd fan 337, 3rd fan 338, 4th fan 339, 5th fan 340, 6th fan 341, 7th fan 342, and an 8th fan 343. At the bottom of the Cooler Modules in both types of cooling are ceramic-plated fiberglass bottoms. The present invention has a 1st fiberglass bottom 326, 2nd fiberglass bottom 327, 3rd fiberglass bottom 328, 4th fiberglass bottom 329, 5th fiberglass bottom 330. These fiberglass bottoms provide heat insulation so that the bottom of the pillow does not get too hot. They also help to prevent heat from escaping into the rest of the pillow. The fiberglass bottoms have ceramic tops so that the heat sinks are secure within the Cooler Modules. The ceramic also provides insulation to the cooler module.

Figure 4:
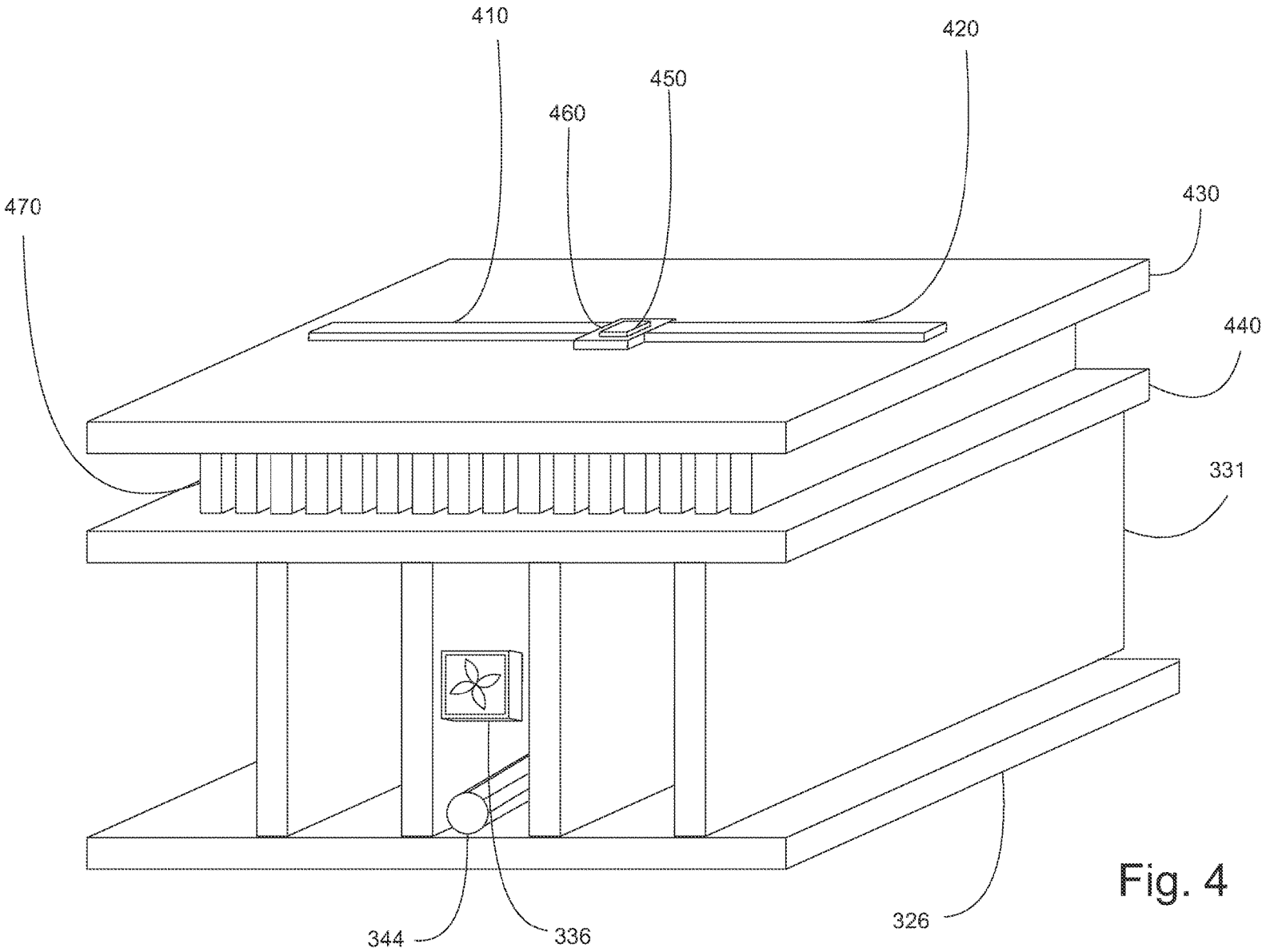
FIG. 4 is a detail view of the Cooler Module.

As seen in FIG. 4, a Cooler Module has a 1st LED Light Strip 410, and a 2nd LED Light Strip 420. The light strips are connected to a pressure sensor 450. The pressure sensor has a pressure sensor backing 460 for support. The LED light strips are connected to the pressure sensor 450. When the pressure sensor 450 senses a high enough pressure, the LED light strips will either turn off or change colors depending on the user's preference. The pressure sensors 450 also gauge the sleep patterns of the user based on movement. The connected device 50 can be used to change the pattern of the LED Light Strip and set different interactions with the 1st LED Light Strip 410 or the 2nd LED light Strip 420. Under the LED Light Strips and the pressure sensor is the Peltier Cooler. The Peltier Cooler has an upper ceramic substrate 430 and a lower ceramic substrate 440. The ceramic substrates are electrical insulators and keep the current within the Peltier Cooler for as much cooling efficiency as possible. In between the ceramic substrates are Thermoelectric Legs 470. Thermoelectric Legs 470 use electric current to move heat from one side to the other. Below the lower ceramic substrate lies the heatsink groupings 331. These heatsink groupings pull heat from the lower ceramic substrate which can be removed with the liquid tube 344 or the fans 336. Connected below the heatsink is the ceramic top of the fiberglass bottom 326. The fiberglass bottom 326 insulates the bottom of the pillow so that it does heat up.

The present invention cooling pillow can have medical or nonmedical use with liquid or air cooling or a combination of liquid and air cooling.

The invention claimed is:

1. A cooling pillow comprising:

a. a cooler module;

b. a heatsink module, wherein the heatsink module is a part of the cooler module;

c. a peltier cooler having a bottom side and a top side, wherein the peltier cooler transfers heat from the bottom side to the heatsink module, wherein the peltier cooler is a part of the cooler module;

d. a water tube, wherein the water tube absorbs heat from the heatsink module, wherein the water tube is fluidly connected to the heatsink module, wherein the water tube is a part of the cooler module;

e. a fiberglass bottom having a ceramic top, wherein the fiberglass bottom stabilizes the heatsink module, wherein the fiberglass bottom insulates the heat within the cooler module, wherein the fiberglass bottom is a part of the cooler module;

f. a pressure sensor, and wherein the pressure sensor measures pressure from a user, wherein the pressure sensor is a part of the cooler module;

g. a light strip, wherein the light strip is connected to the pressure sensor, and wherein the light strip lights up according to a connected device;

h. a fan, wherein the fan is formed in the cooler module, and wherein the fan blows air onto the heatsink module;

i. a pillow case, wherein the pillow case is situated around the pillow;

j. a pillow cover, wherein the pillow cover is situated around the pillow case, and wherein the pillow cover passively cools the user;

k. an air conduit, wherein the air conduit releases air from the fan, wherein the fan transfers heat from the heatsink out of the air conduit;

l. a foam body, wherein the foam body surrounds cooler module columns, and wherein the foam body is infused with phase change material gel;

m. an electrical plug, wherein the electrical plug powers the cooler module columns; and n. a cooler module column, wherein the cooler module column comprises ten cooler modules, wherein the cooler module column arranged the cooler modules parallel to one another, and wherein the cooler module column receives electrical power from the electrical plug.

2. The cooling pillow of claim 1, further comprising a phase change material pack, wherein the cooler module cools the phase change material pack.

3. The cooling pillow of claim 1, further comprising a phase change material pack casing, wherein the phase change material pack casing encloses the phase change material pack.

4. The cooling pillow of claim 1, further comprising a wireless connector, wherein the wireless connector includes a connection to a connected device, wherein the wireless connector is configured to receive control signals from the connected device.

5. The cooling pillow of claim 1, further comprising:

a. a pillow antenna, wherein the pillow antenna is formed within the cooler module; and b. a connected device, wherein the connected device is wirelessly connected to the pillow antenna.

6. The cooling pillow of claim 1, further comprising a radiator, wherein the radiator is a passive cooling radiator, and wherein the water tube transfers heat from the heatsink module to the radiator.

7. The cooling pillow of claim 6, further comprising a phase change material pack, wherein the cooler module cools the phase change material pack.

8. The cooling pillow of claim 6, further comprising a phase change material pack casing, wherein the phase change material pack casing encloses the phase change material pack.

9. The cooling pillow of claim 6, further comprising a wireless connector, wherein the wireless connector includes a connection to the connected device, wherein the wireless connector is configured to receive control signals from the connected device.

10. The cooling pillow of claim 6, further comprising:

a. a pillow antenna, wherein the pillow antenna is formed within the cooler module; and b. a connected device, wherein the connected device is wirelessly connected to the pillow antenna.

* * * * *